US005368435A

United States Patent [19]

Bostad et al.

[11] Patent Number: 5,368,435

[45] Date of Patent: Nov. 29, 1994

[54] SIDE SHIFTER ATTACHMENT AND RETAINER FOR LIFT TRUCK ATTACHMENTS

[75] Inventors: Wayne W. Bostad, Vancouver, Wash.; Donald C. Morrison, Gresham, Oreg.; Dean J. Mao, Vancouver, Wash.

[73] Assignee: Brudi, Inc., Ridgefield, Wash.

[21] Appl. No.: 10,424

[22] Filed: Jan. 28, 1993

[51] Int. Cl.[5] ..... B66F 9/14

[52] U.S. Cl. ..... 414/667; 414/785

[58] Field of Search ..... 414/667, 671, 607, 608, 414/785

[56] References Cited

U.S. PATENT DOCUMENTS

| | | | |
|---|---|---|---|
| 3,974,927 | 8/1976 | Schuster | 414/667 |
| 4,173,425 | 11/1979 | Dixon et al. | 414/667 |
| 4,355,947 | 10/1982 | Wiblin | 414/785 |
| 4,392,773 | 7/1983 | Johannson | 414/667 |
| 4,406,575 | 9/1983 | Gaibler | 414/667 |
| 4,607,997 | 8/1986 | Asano | 414/667 |
| 4,619,579 | 10/1986 | Frison | 414/607 |
| 4,699,565 | 10/1987 | Seaberg | 414/607 X |
| 4,828,450 | 5/1989 | Adamski et al. | 414/607 |
| 4,961,681 | 10/1990 | Threatt | 414/607 |
| 5,026,245 | 6/1991 | Sabo | 414/785 X |
| 5,139,385 | 8/1992 | Chase et al. | 414/667 |
| 5,147,171 | 9/1992 | Murray et al. | 414/671 |
| 5,217,343 | 6/1993 | Bostad et al. | 414/667 |

FOREIGN PATENT DOCUMENTS

| | | | |
|---|---|---|---|
| 280796 | 9/1988 | European Pat. Off. . | |
| 2306931 | 11/1976 | France | 414/667 |
| 252118 | 2/1967 | Germany . | |
| 2716668 | 10/1978 | Germany . | |
| 3123692 | 12/1982 | Germany . | |
| 8201527 | 11/1983 | Netherlands | 414/667 |
| 2007186 | 5/1979 | United Kingdom . | |

OTHER PUBLICATIONS

Brochure by Bolzoni Inc. entitled "Side Shifter By Bolzoni", undated.

*Primary Examiner*—David A. Bucci

*Attorney, Agent, or Firm*—Emch, Schaffer, Schaub & Porcello Co.

[57] ABSTRACT

A side shifter (20) attachment for a lift truck (10) having an upper crossbar (44) and a lower crossbar (46) is disclosed. The side shifter has a rigid frame (24) slideably positioned with respect to the upper and lower crossbars (44, 46) of the lift truck. The frame (24) has an upper horizontal cross member (26) and a lower horizontal cross member (28). A low-friction slide block (80)is positioned on the lower horizontal cross member (28). A lower intermediate plate (81) having a first (75) and a second (77) surface is positioned between the slide block (80) and the lower crossbar (46). The first surface (75) is in contact with the slide block (80) and the second surface is in contact with the lower crossbar (46). At least the first surface (75) of the lower intermediate plate (81) has a smooth, low-friction surface to facilitate sliding of the lower horizontal cross member (28) with respect to the lower crossbar (46). Also disclosed is a retainer (22) for securing a lift truck attachment (20) to a lift truck carriage. The retainer (22) includes a retainer plate (56) having a hook (58) on one end that is slideably positioned on the attachment. The hook (58) is disposed to engage the carriage of the lift truck (10). An opening (90) is positioned in the retainer plate (56). A block (118) is movably secured to the attachment. The block (118) is disposed to be positioned in the opening in the retainer plate (56) to maintain the retainer plate (56) in a desired position with respect to the carriage of the lift truck (10).

22 Claims, 5 Drawing Sheets

18
38
36
34
35
37
27
33
26
40
48
39
52
16
55
44
12
85
87
17
46
71
80
56
83
28
70
96
111
60
100
98
22
58
86
55
10
14

SIDE SHIFTER ATTACHMENT AND RETAINER FOR LIFT TRUCK ATTACHMENTS

TECHNICAL FIELD

This invention is directed to a side shifter attachment and a mechanism for securing attachments to lift trucks. The side shifter has a frame or carriage that is mounted onto the lift truck in a manner that allows the carriage to be shifted from side to side relative to the lift truck. The carriage is designed to carry forks that are shifted with the carriage into position to lift or move a load.

BACKGROUND ART

Lift trucks are well-known vehicles for handling loads. Conventional lift trucks include a pair of forwardly projecting forks for engaging the underside of the load. The forks are mounted to a carriage that is driven for lifting and lowering the load that is carried by the forks.

Lift trucks are commonly used in warehouses, transfer yards, etc., for handling a variety of items. A large percentage of the items are loaded into containers or on pallets. The lift truck forks are maneuvered by the lift truck operator into receiving pockets provided in the containers or pallets. Controls enable the operator to raise the forks and its load which is then transferred as desired. (Hereafter references to pallets will be understood to be interchangeable with containers otherwise used for carrying or containing items which make up a load).

Several attachments are available for enhancing the capabilities of a lift truck. One important attachment is known as a side shifter. A side shifter attaches to the lift truck carriage and provides a mechanism for lateral movement of the forks. With side shifting capability, a lift truck operator does not have to precisely align the lift truck with the pallet pockets. If the forks are not aligned in the desired position, the side shifter can be engaged to position the forks in the desired position. Side shifters eliminate a substantial amount of lift truck movement that would otherwise be required to achieve the lateral movement of loads or forks.

A lift truck carriage includes upper and lower horizontal crossbars. A side shifter generally comprises a rigid frame that attaches to those crossbars. In this regard, the side shifter frame includes upper and lower cross members. The upper cross member is mounted to the upper crossbar of the carriage, and the lower cross member is secured by one or more retainers to the lower crossbar of the carriage. The lift truck forks are then mounted to the side shifter frame.

A drive mechanism, such as a hydraulic cylinder, is interconnected between the lift truck carriage and the side shifter frame for moving the side shifter relative to the carriage. The side shifter retainers are configured to secure the side shifter frame to the carriage while allowing the side shifter to slide along the carriage. Low-friction slide blocks are placed between the side shifter and the carriage to facilitate the sliding movement of the side shifter.

A problem with prior art side shifters is that the rigid frame for the side shifter is bulky and reduces forward vision for the operator of the fork lift truck. This makes it difficult to maneuver in tight places and to precisely position loads with the fork lift truck.

The upper and lower crossbars of the lift truck are structural pieces that must be capable of supporting and handling heavy loads. The finish on the crossbars is usually rough and becomes rougher during use. The lower crossbar usually has an "as rolled" surface finish that contains mill scale. The "as rolled" surface has a high coefficient of friction and provides a very poor surface on which to slide a side shifter. The high friction surface on the crossbars of the fork lift truck increases the force necessary to slide the side shifter and increases the wear on the components of the side shifter that slide over the crossbars. To further compound this problem, contaminants frequently are present in the interface between the crossbars and the side shifter. This is especially true with regard to the lower crossbar. The contaminants can further reduce the slideability of the side shifter on the crossbars.

Most modern lift trucks are built in conformance with standards recommended by the Industrial Truck Association (ITA) or by the International Organization for Standardization (ISO). One such standard establishes the minimum clearance that should exist between the ground and the underside of the lower crossbar of a lift truck carriage whenever the carriage is in its lowest position. In the past, the retainers used to secure side shifters to the lower crossbar of the carriage were so configured than they extended substantially below the underside of the crossbar. As a result, the clearance between the ground and the lowermost portion of the side shifter (i.e., the underside of the retainer) was often significantly less than the recommended standard referred to above. Consequently, prior retainers occasionally contact raised obstructions on the surface over which the lift truck operates. Such contact may damage the side shifter or cause dangerous shifting of the load.

DISCLOSURE OF INVENTION

The invention is directed to a low-friction intermediate plate that is positioned between the lower crossbar of a fork lift truck and the slideable frame of a side shifter attachment. The intermediate plate provides a low-friction surface upon which the side shifter can slideably move and reduces the force necessary to move the side shifter. A seal can be provided between the intermediate plate and the side shifter to reduce the presence of unwanted contaminants at the interface between the side shifter and intermediate plate.

An aspect of the invention is that a high strength ferrous extrusion is used for the upper horizontal cross member of the slideable frame of the side shifter. It is also possible to use high strength ferrous extrusions for the other components of the slideable frame. The ferrous extrusions are stronger than the steel previously used and allow the cross-sectional dimensions of the components of the frame to be reduced. This allows the frame to be more open and improves visibility through the side shifter.

This invention is also directed to a retainer for securing the lower cross member of a lift truck attachment to a lift truck carriage. The retainer includes an adjustment mechanism that permits the retainer to move into several positions to properly engage the lower carriage crossbar of the lift truck. This adjustment feature ensures that the crossbar is properly engaged by the retainer despite variations from one lift truck to another in the configuration of the lift truck carriage.

As another aspect of this invention, the adjustment mechanism is combined with a quick-detach mechanism, which permits rapid movement of the retainer into and out of engagement with the lower crossbar of the lift truck carriage. The quick-detach mechanism supplements the adjustment feature just described.

BEST MODE OF CARRYING OUT INVENTION

Figure 1:
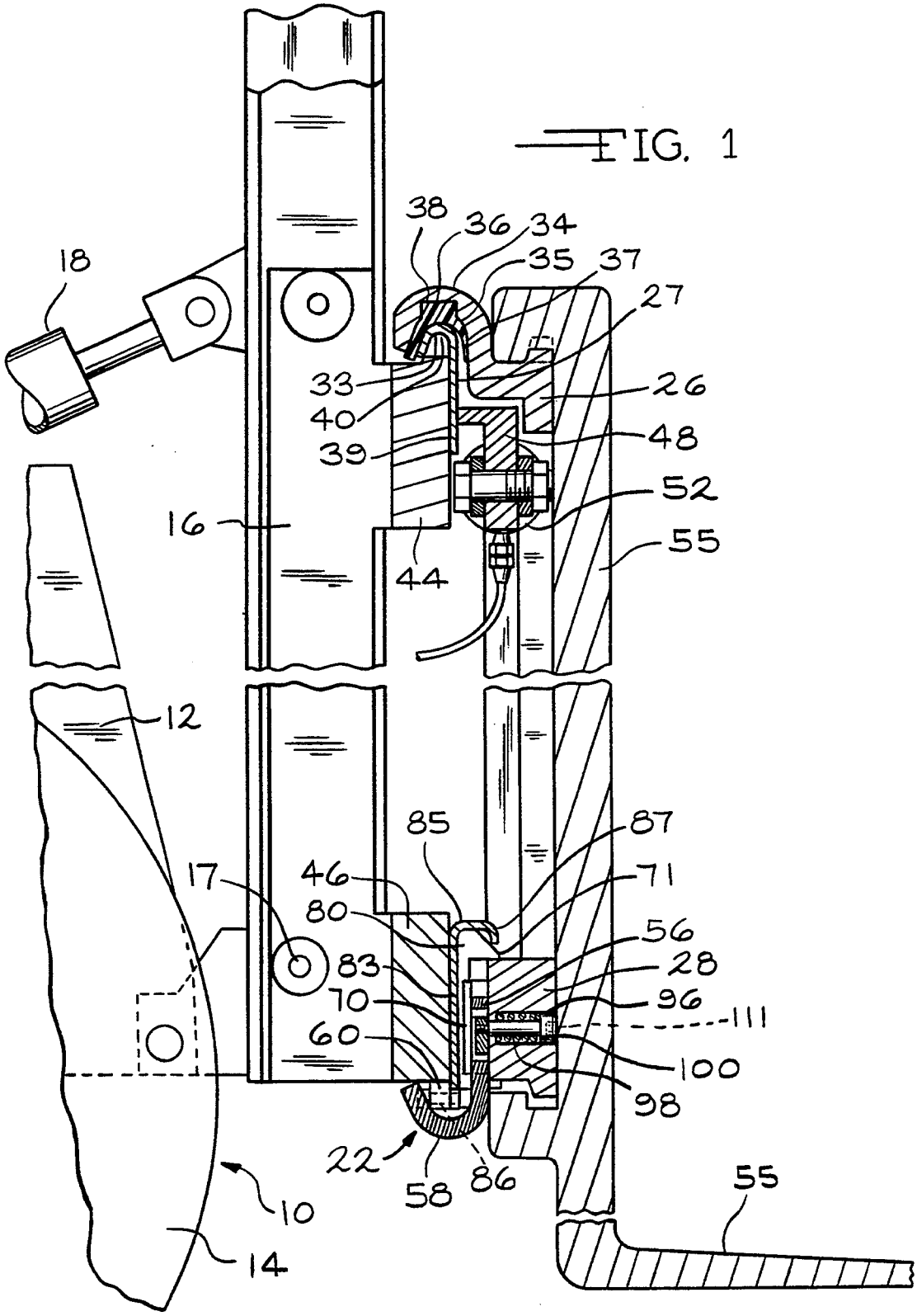
FIG. 1 is a cross-sectional view of the side shifter and retainer of the present invention.

The side shift attachment and retainer of this invention are designed for use with a lift truck. The lift truck 10, as shown partially in FIG. 1, includes a body 12, front wheels 14 and rear wheels (not shown). The front and rear wheels can both be steerable to increase the maneuverability of the lift truck. Uprights 16 are pivotally mounted at pivots 17 to the lower front end of the body 12. A hydraulic motor 18 is attached to the upper end of the uprights 16 and to the body 12 to control the tilting action of the uprights about pivot 20. An upper crossbar 44 and a lower crossbar 46 are slideably secured in a horizontal orientation on the uprights 16. A hydraulic cylinder (not shown) is positioned between the uprights 16 and the upper and lower crossbars 44, 46 to provide for vertical movement of the upper and lower crossbars. The above components of a lift truck are all standard, well known components and will not be described further.

A lift truck attachment known as a side shifter 20 is shown in FIGS. 1–5. The side shifter 20 generally comprises a rigid frame 24 having an upper horizontal cross member 26 and a lower horizontal cross member 28. The ends of the upper and lower cross members 26, 28 are joined to vertical support members 30, 32, Intermediate vertical support members 31 are positioned between the upper and lower cross members 26, 28.

A slide channel 34 is formed in the back (i.e,, the surface facing away from the viewer of FIG. 2) of the upper cross member 26 of the side shifter frame 24. The slide channel 34 extends along the entire length of the upper cross member and forms a downwardly opening groove 36. A low-friction slide bearing 38 (FIG. 2), formed of material such as nylon or bronze is fit into each groove 36. Such a nylon material is manufactured by Polymer Corporation, Philadelphia, Pa., under the trademark NYLATRON®. The slide bearing 38 also defines a generally rounded channel 37.

The loads on the upper and lower horizontal cross members 26, 28 are in a downward and forward direction. On prior art side shifters, the slide channel was formed from two relatively short castings that were welded to the upper horizontal cross member 26. The prior art configuration for the slide channel did not contribute significantly to the strength of the upper horizontal cross member.

In the present invention the upper horizontal cross member 26 is formed from a high strength ferrous extrusion. The use of a ferrous extrusion allows the upper horizontal cross member 26 and slide channel 34 to be formed as one piece. The integrally formed slide channel 34 adds stiffness to the upper cross member 26 and particularly increases the forwardly directed load carrying capacity of the upper cross member 26. Because of the improved stiffness of the extruded slide channel 34 and upper cross member 26 the vertical section of the upper cross member can be reduced without reducing the load carrying capacity of the side shifter 20.

The lower horizontal cross member 28 and vertical support members 30, 32 also can be formed from high strength ferrous extrusions. The ferrous extrusions are stronger than the steel previously used on these components. The increased strength of the ferrous extrusions allows the cross-sectional size of the upper and lower horizontal cross members 26, 28 and the vertical support members 30, 32 to be considerably smaller than on prior art side shifters. In particular, the vertical section of the lower horizontal cross member 28 and the horizontal section of the vertical support members 30, 32 are reduced. The reduced section for the components increases the viewing area through the side shifter 20 and facilitates use of the side shifter.

An upper intermediate plate 33 is positioned in the generally rounded channel formed by the slide bearing 38. The upper intermediate plate 33 is a thin metal plate having a first side 27 with a polished or very smooth surface finish. The second side 39 of the upper intermediate plate 33 rests upon the upper specially shaped edge 40 of the upper crossbar 44 of a lift truck carriage. The upper intermediate plate 33 is positioned in the slide channel 34 and extends along the surface of the upper crossbar 44 that faces the side shifter 20.

A lug (not shown) is positioned in the portion of the intermediate plate 33 that faces the upper crossbar 44 of the lift truck carriage. The lug 41 is disposed to engage a notch (not shown) located in the upper surface of the upper crossbar. Such notches are well known in the lift truck industry. The lug positions the upper intermediate plate and acts to restrain the upper intermediate plate from movement with respect to the upper crossbar 44. A generally flat first bracket 48 is fastened to extend downwardly from the upper intermediate plate 33. A similarly configured second bracket 50 is fastened to extend downwardly from the upper cross member 26 of the side shifter frame 24. A dual-action hydraulic cylinder 52, having a clevis 54 on each end, is interconnected between the first bracket 48 and the second bracket 50. Actuation of the cylinder 52 moves the first and second brackets 48, 50 apart or together to cause the side shifter 20 to move from side to side (i.e., into and out of the plane of FIG. 1) relative to the lift truck carriage.

The cross members 26, 28 of the side shifter frame 24 are shaped in cross section (see FIG. 1) to generally conform to the cross-sectional shape of the lift truck crossbars 44, 46. Whenever the side shifter 20 is attached to the lift truck carriage, the forks 55 are mounted by known means to the side shifter cross members 26, 28 and extend from the side shifter as shown in FIG. 1.

Figure 4:
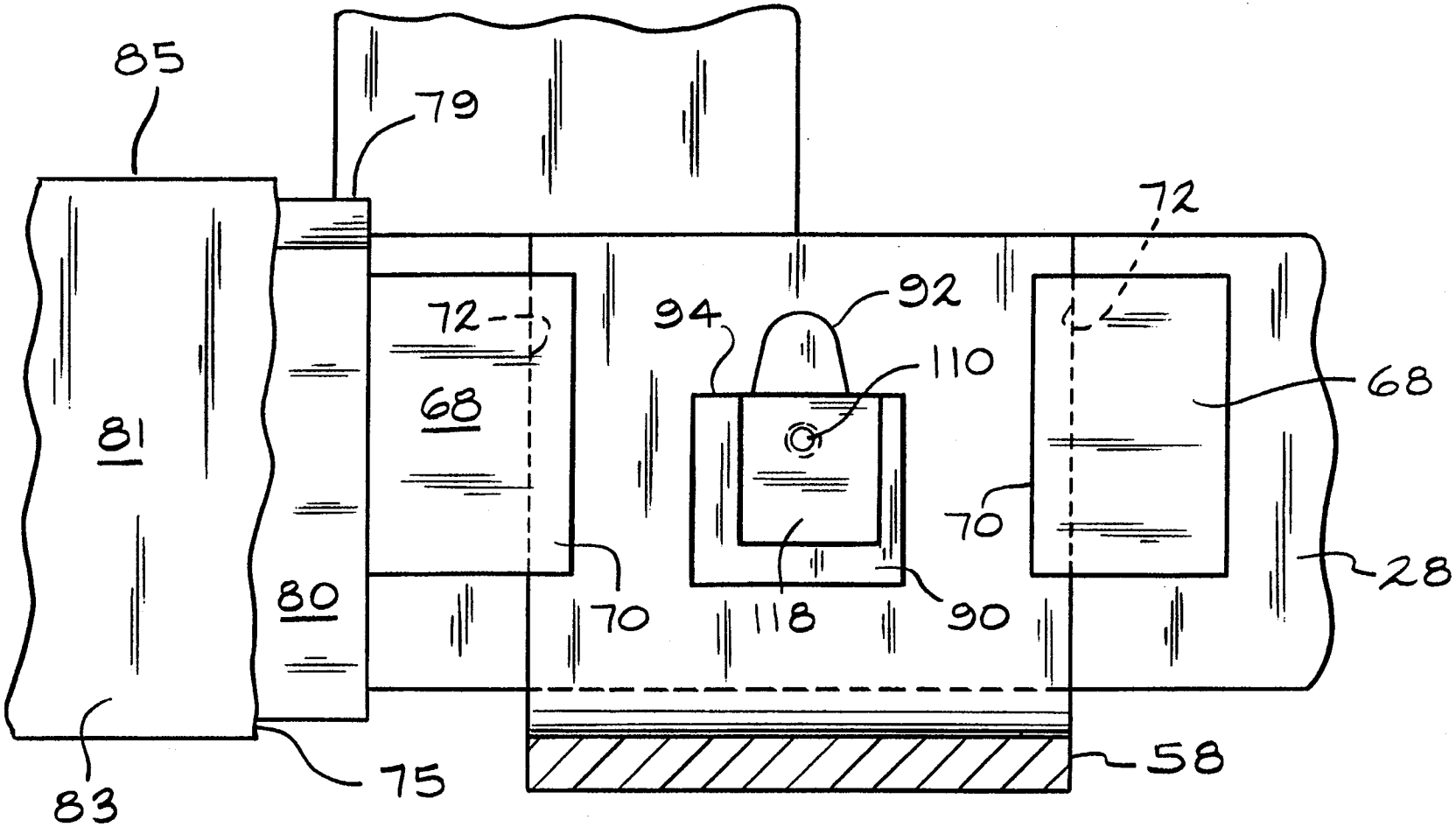
FIG. 4 is a partial front elevation view of the retainer and the side shifter of the present invention.
Figure 5:
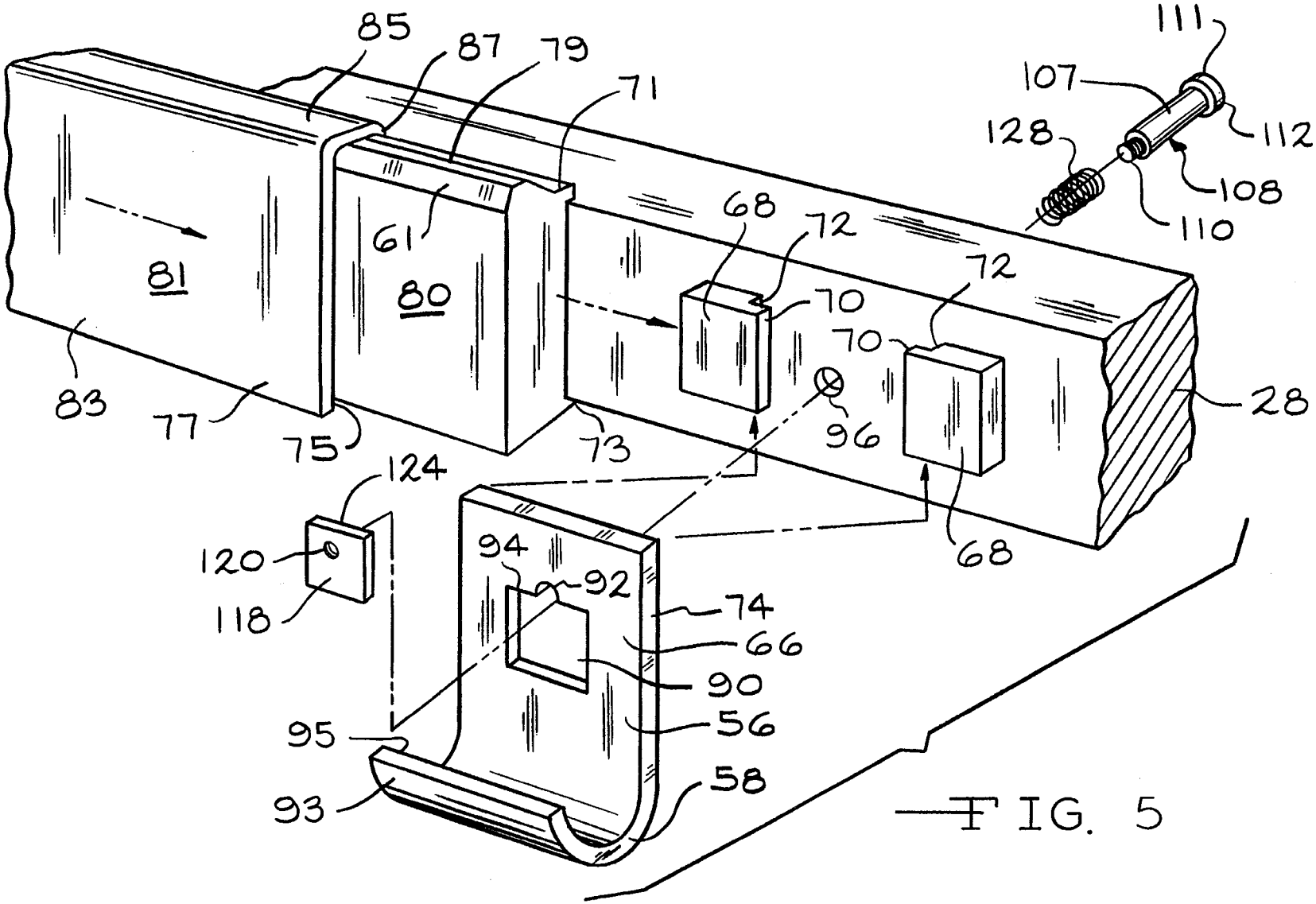
FIG. 5 is an exploded perspective view of the retainer as used on a side shifter.

The lower cross member 28 of the side shifter 20 is secured adjacent to and in sliding contact with the lower crossbar 46 of the carriage by retainers 22. Preferably, two retainers 22 are mounted in spaced apart relationship to the back of the lower cross member 28 of the side shifter frame 24. One of the retainers 22 is shown in FIGS. 1, 4 and 5.

Each retainer 22 comprises a rigid unitary retainer plate 56 that is formed from, for example, a steel plate. The lower end of the retainer plate 56 is bent rearwardly (i.e., to the left) in FIG. 1) to form a hook 58 that is sized to engage the downwardly projecting lip 60 that is found on the underside of the lower crossbar 46 of conventional lift truck carriages.

The retainer 22 is held between two rigid mounting brackets 68 that are fastened, such as by welding, to the back of the lower cross member 28 of the side shifter frame 24. Each mounting bracket 68 is formed with a tongue 70 that defines a slot 72 into which fits a vertical edge 74 of the mid-portion 66 of the retainer plate 56. The slots 72 are sized so that the retainer plate 56 is able to slide upwardly and downwardly for position adjustment as described more fully below.

A slide block 80, formed of low-friction material such as ultra high molecular weight (UHMW) polyethylene, is positioned between two mounting brackets 68. The mounting brackets 68 that are on opposite ends of the lower cross member 28 keep the slide block 80 from moving in the horizontal direction relative to the lower cross member 28. The slide block 80 has an upper extension 71 that extends above the top of the lower cross member 28 and a lower extension 73 that extends over a portion of the lower cross member 28. The upper and lower extensions 71, 73 fit onto the lower cross member 28 and act to keep the slide block 80 from moving in a vertical direction. The slide bock 80 forms a ridge 61 having a truncated peak 79 in the area above the retainer plate. A generally J-shaped lower intermediate plate 81 having a first surface 75 and a second surface 77 is positioned between the slide block 80 and the lower cross bar 46. The first surface 75 is in contact with the slide block 80 and the second surface 77 is in contact with the lower crossbar 46. The lower intermediate plate is a thin metal plate and at least the first surface 77 has a polished or very smooth surface finish. The lower intermediate plate 81 has a leg section 83, a base 85 and a lip 87 that extends from the base in opposed substantially parallel relationship to the leg 83. The base 85 is disposed to be positioned over and in contact with the peak 79 of the slide block 80 and the leg 83 is positioned along the surface of the slide block that is spaced apart from the lower cross member 28. The lip 87 is positioned to engage the upper extension 71 of the slide block 80. The base 85 and lip 87 form a seal with the slide block 80 to prevent dirt or other contamination from getting between the slide block and the lower intermediate plate 81. The lower intermediate plate 81 has at least one lug 86 that is secured to the leg section 83. The lug 86 is disposed to extend from the leg section and to engage a notch in the lower crossbar 46. The lug 86 keeps the lower intermediate plate from moving relative to the lower crossbar 46 during operation of the side shifter 20.

As best seen in FIG. 1, the slide block 80 is thicker than the mounting brackets 68 so that the outer face of the block 80 that is spaced apart from the lower cross member 28 bears against the vertical leg 83 of the lower intermediate plate 81 to facilitate sliding of the lower cross member 28 relative to the lower crossbar 46.

Figure 3:
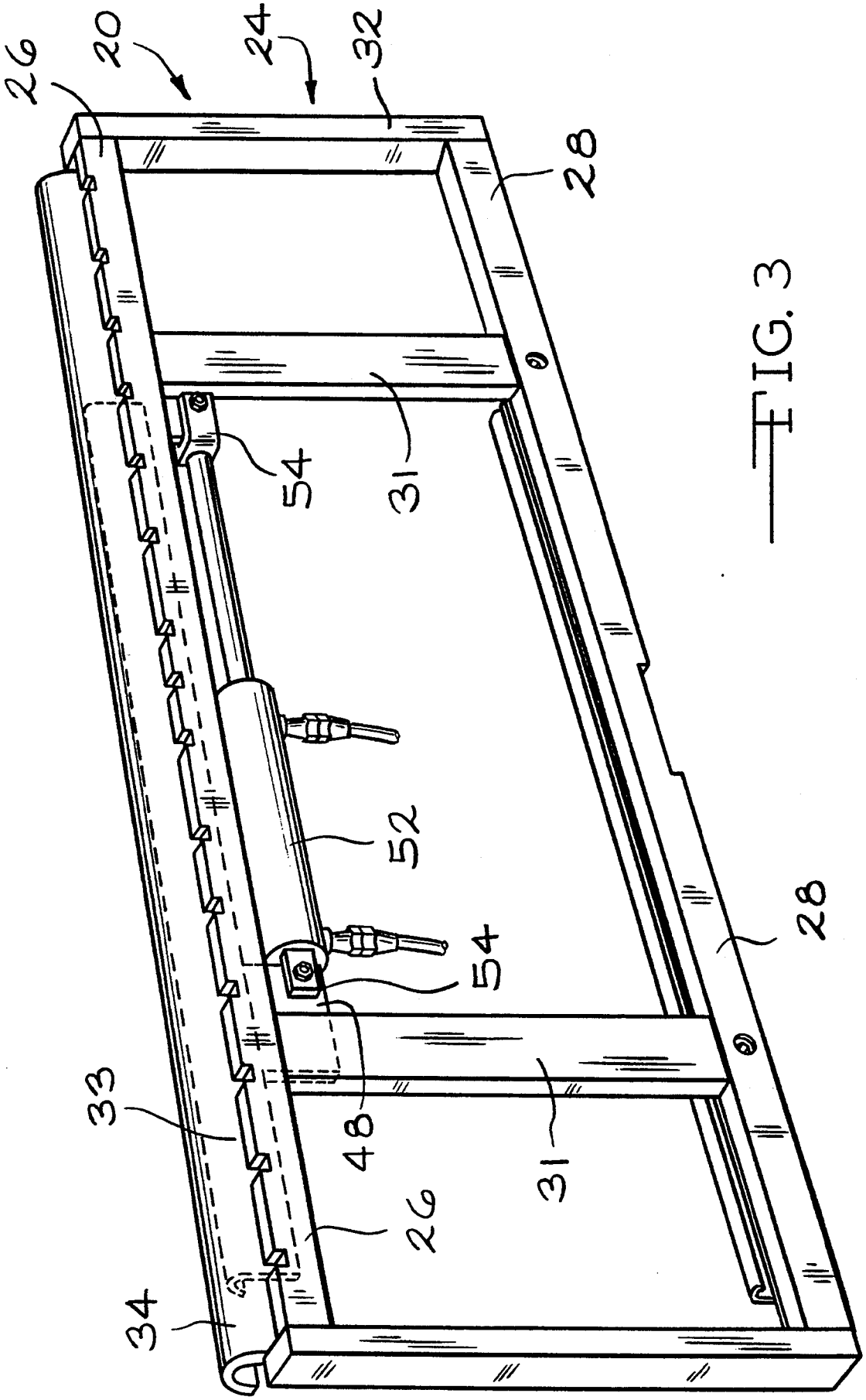
FIG. 3 is a perspective view of the invention.

The upper and lower intermediate plates 33, 81 provide a smooth low-friction surface on which the slide bearing 38 and slide block 80 can slide during operation of the side shifter 20. The smooth surface of the upper and lower intermediate plates reduce the force that is necessary to slide the side shifter frame 24 relative to the upper and lower crossbars 44, 46 for the lift truck 10. The reduced force for movement of the side shifter 20 can allow a smaller hydraulic cylinder 52 to be utilized to move the side shifter frame 24. A smaller hydraulic cylinder can result in the side shifter 20 having a reduced thickness which can reduce the "load moment arm" for the side shifter. The "load moment arm" is the distance from the load to the center of the front wheels. Reducing the load moment arm allows the side shifter equipped lift truck to handle heavier loads and to operate in more confined spaces. FIG. 3 shows the side shifter 20 where the frame 24 has been moved in a horizontal direction relative to the lift truck 10 by activating the hydraulic cylinder 52.

The smooth low-friction surfaces on the upper and lower intermediate plates 33, 81 also promote a smoother movement of the side shifter 20 so that it is easier for the operator to position the forks 55 mounted on the side shifter. The upper and lower intermediate plates 33, 81 also reduce the wear experienced by the slide bearing 38 and slide block 86. The smooth low-friction surfaces of the upper and lower intermediate plates is much easier on the NYLATRON® material of the slide bearing 38 and the UHMW polyethylene material of slide block 80 than the rough surfaces of the upper and lower crossbars 44, 46.

The seal formed between the lower intermediate plate 81 and the slide block 80 further protects the slide block 80. The slide block 80 in prior art side shifters is exposed to dirt and other contaminants that can compromise the performance of the slide block. The position of the slide block 80 at the bottom of the side shifter places it where dust, dirt and other undesirable substances generated by the movement of the lift truck can come into contact with the slide block. All of these substances have the potential to compromise the functioning of the slide block. The J-shaped lower intermediate plate 81 of the present invention extends over the top of and forms a seal with the slide block 80. The shape of the lower intermediate plate and the seal formed with the slide block reduces the likelihood of contaminants entering the sliding interface between the lower intermediate plate 81 and the slide block 80.

The retainer plate 56 of the retainer 22 (see FIGS. 4 and 5) defines a substantially rectangular opening 90 that is located in a portion of the retainer plate 56 that fits between the mounting brackets 68. The upper edge 94 of the opening 90 can contain a notch 92. The lower horizontal cross member 28 defines a passageway 96 that extends through the lower horizontal cross member. The passageway 96 is generally cylindrical in shape and has a section 98 of reduced diameter that is located adjacent to the side of the lower horizontal cross member 28 that is adjacent the mounting bracket 68. A shoulder 100 is formed where the section of reduced diameter 98 intersects with the remainder of the passageway 96. A bolt 108 having a shaft 107 with a threaded portion 110 on one end and a head 112 located on the other end is positioned in the passageway 96. The head 112 of the bolt 108 contains a female hex socket 111. The bolt 108 has a cross-sectional shape that allows the bolt to slideably move in the section of reduced diameter 98 of the passageway 96. In practice, it has been found that a block 118 that is substantially square in shape works particularly well. A block 118 having a threaded aperture 120 is threadingly secured to the threaded portion 110 of the bolt 108. The block 118 is substantially rectangular in shape and is sized to fit within the opening 90 defined in the retainer plate 56. The block 118 is of a size that it will not fit within the passageway 96. The block 118 is eccentrically mounted on the bolt 108 so that each edge 124 of the block 118 is spaced a different distance from the centerline of the threaded aperture 120. A biasing means 128 is positioned in the passageway 96 to bias the bolt 108 so that the block 118 is held against the surface of the lower horizontal cross member 28 between the mounting brackets 68. The biasing means 128 is usually a spring that engages the shoulder 100 in the passageway 96 and head 112 of the bolt 108. The spring also acts to bias the bolt 108 in a direction where the block 118 is positioned in the opening 90 in the retainer plate 56.

In operation, the bolt 108 is advanced into the passageway 96 in a direction to compress the biasing means 128. The bolt 108 can be advanced by placing an Allen-type wrench in the hex socket 111 and then advancing the Allen wrench in the desired direction. This displaces the block 118 from the opening 90 in the retainer plate 56. This allows the retainer plate 56 to be raised and lowered until the retainer plate is in the desired position engaging the lower crossbar 46 on the fork lift truck. The amount of vertical adjustment or movement for the retainer plate 56 is limited by the size of the opening 90 and how much clearance there is between the edges of the opening 90 and the bolt 108. To provide additional movement in the downward direction, a notch 92 can be provided in the top edge of the opening 90. The notch 92 is large enough to fit around the shaft of the bolt 108 to allow the retainer plate 56 to advance in a downward direction for a greater distance. Once the retainer plate 56 is in the proper position, the block 118 is again positioned in the opening 90. The block can be rotated by rotating the bolt 108 so that the edge 124 of the block 118 that maintains the retainer member 56 in the proper position is in engagement with the upper edge 94 of the opening 90. Rotation of the bolt 108 can be facilitated by using an Allen wrench to engage the hex socket 111 in the head 112 of the bolt. Rotation of the Allen wrench will cause the bolt 108 to rotate appropriately. If it is necessary to adjust the position of the retainer plate 56 and the hook due to wear or other factors encountered during use, the bolt 108 can be again advanced into the passageway 96 to disengage the block 118 from the opening 90. Once this has been accomplished, the retainer plate 56 can be placed in the desired position and the bolt 108 rotated until the appropriate edge 124 of the block 118 engages the upper edge 94 of the opening 90 to retain the retainer plate 56 in this desired position. Because the block 118 has four edges that are all spaced a different distance from the center point of the bolt 108 upon which the block is mounted, there are four different adjusting heights that can be utilized to position the retaining plate 56. It should also be noted that if the edges for the block 118 do not provide sufficient adjustment for the retaining bracket 56 it would be possible to position another block 118 on the bolt 108 where the edges of the block 118 are spaced from the centerline of the bolt 108 different distances than the original block 118. The new block would then allow the retaining plate 56 to be positioned in additional vertical positions with respect to the lower crossbar 46 of the fork lift.

The opening 90 and the block 118 have been described as being substantially rectangular in shape. It is believed that this is the preferred construction for these elements. However, it should be understood that other shapes and configurations can be utilized for the opening 90 and the block 118 without departing from the scope of the present invention.

As the retainer plate 56 moves into the raised position, the tip 93 of the hook 58 moves near the flat back surface of the projecting lip 60 of the crossbar 46 to prevent the lower cross member 28 from moving forwardly from the lower crossbar 46 of the carriage. Preferably, the tip 93 of the retainer plate hook 58 includes a generally flat inner face 95 that is disposed in a plane that is substantially parallel to the plane of the back surface of the projecting lip 60.

During normal operation, the tip 93 of the retainer plate hook 58 is spaced slightly away from the protruding lip 60 of the crossbar 46 so that no friction is generated as the side shifter 20 is slid along the carriage. The hook tip 93 contacts the lip 60 only in the event that the shifter 20 is forced forwardly, such as when the load carried by the lift truck contacts a stationary obstruction as the truck is moving backward. In most applications it is only necessary to adjust the position of the retainer plate 56 in response to wear in the slide bracket 34 that moves relative to the upper horizontal cross member 26. However, since the retainer plate hook 58 is designed to usually be slightly spaced apart from the lip 60 of the crossbar 46, it is only necessary to have an incremental-type adjustment of the retainer plate 56.

The hook 58 of the retainer plate 56 is configured so that it fits closely to the carriage lip 60. Consequently, the retainers 22 do not significantly reduce the crossbar 46 clearance above the surface over which the lift truck is moved. More particularly, the retainer plate 56 is configured so that the vertical distance between the underside of a conventional carriage lip 60 and the undersurface of the hook 58 is 0.62 inches or less. Prior retainers typically extend as much as 1.92 inches below the carriage lip 60. It can be appreciated, therefore, that the present invention provides a retainer that, when compared to prior retainers, is far less likely to interfere with movement of a lift truck over surfaces that may include raised obstructions.

It can be appreciated that the vertical distance may vary slightly from the dimension just described. For example, a carriage lip that is sized larger or smaller than the lip 60 just mentioned may require a hook 58 that is shaped to extend more or less than 0.62 inches beneath the lip.

Figure 2:
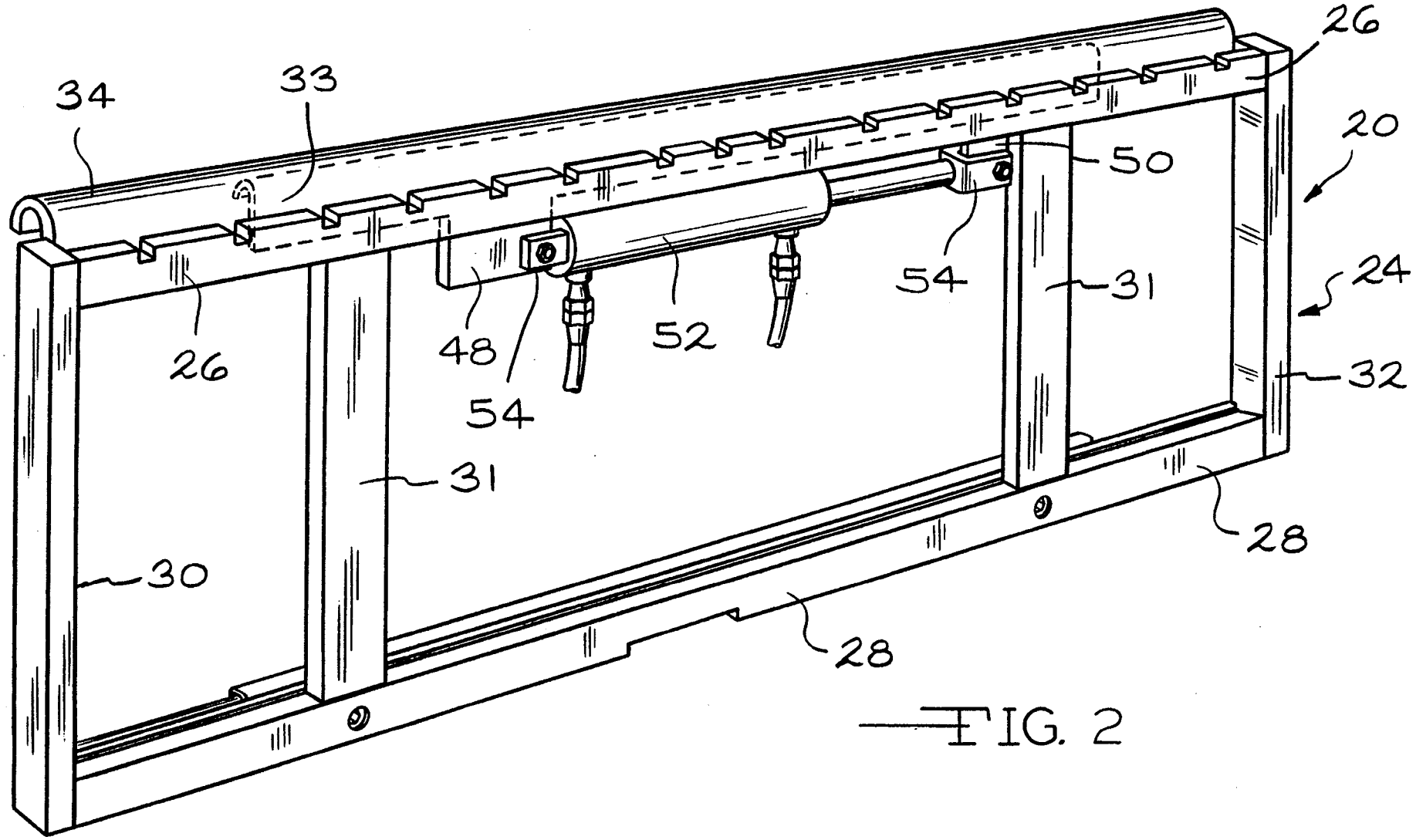
FIG. 2 is a perspective view of the invention.

The hook 58 defines a continuous curve in cross section (FIG. 2). This curved surface of the hook 58 is an advantageous feature of the present invention because it reduces the likelihood of a retainer 22 becoming "hung-up" on an obstruction that projects into the path of the hook 58 as the lift truck is moved. When such an obstruction is encountered, the curved surface of the hook 58 tends to slide over the obstruction. Prior retainers, which generally present a flat vertical surface to such obstructions, are less likely to slide over such obstructions and, therefore, contact of such retainers with the obstruction can damage the shifter or cause the load to shift.

The above description of the invention is given for the sake of explanation. Various modifications and substitutions, other than those cited, can be made without departing from the scope of the following claims.

We claim:

1. A side shifter (20) attachment for a lift truck (10), said lift truck having an upper crossbar (44) and a lower crossbar (46), said side shifter comprising:

a rigid frame (24) slideably positioned with respect to said upper and lower crossbars (44, 46) of said lift truck, said frame (24) having an upper horizontal cross member (26) and a lower horizontal cross member (28);

a low-friction slide block (80) positioned on said lower horizontal cross member (28), said slide block improving the slideability between said lower horizontal cross member (28) and said lower crossbar (46);

a lower intermediate plate (81) having a first (75) and a second surface (77) is positioned between said slide block (80) and said lower crossbar (46), said first surface (75) being in contact with said slide block (80) and said second surface being in contact with said lower crossbar (46), at least said first surface (75) of said lower intermediate plate (81) having a smooth, low-friction surface to facilitate sliding of said lower horizontal cross member (28) with respect to said lower crossbar (46); and a drive means (52) having a first end connected to said rigid frame (24) and a second end operatively connected to said upper cross bar (44), said drive means being capable of shifting said rigid frame (24) with respect to said upper and lower cross bars (44,46) of said lift truck, a polished surface of said lower intermediate plate (81) reducing the force necessary by said drive means (52) to move said frame (24) of said side shifter (20).

2. The side shifter of claim 1, wherein said slide block (80) has an upper surface and said lower intermediate plate (81) extends over at least a portion of said upper surface of said slide block (80) to reduce possible contamination between said first surface of said lower intermediate plate (81) and said slide block (80).

3. The side shifter (20) of claim 2, wherein said slide block (80) engages at least a portion of said lower intermediate plate (81) that extends over said upper surface of said slide block (80), said slide block (80) forming a seal with said lower intermediate plate to reduce possible contamination between said first surface of said lower intermediate plate (81) and said slide block (80).

4. The side shifter (20) of claim 3, wherein said lower intermediate plate (81) is generally J-shaped and has a leg (83) that extends between said slide block (80) and said lower crossbar (46), a base (85) that extends from said leg (83) over said upper surface of said slide block (80) in a direction substantially perpendicular to said leg (83) and a lip (87) that extends from said base (85), said lip being spaced apart from said leg (83), said lip extending in a direction that is substantially parallel to said leg (83).

5. The side shifter (20) of claim 4, wherein said upper surface of said slide block (80) forms a ridge (61) having a truncated peak (79), said truncated peak (79) of said ridge (61) being in engagement with said base (85) of said lower intermediate plate (81) whereby a seal is formed between said slide block (80) and said lower intermediate plate (81).

6. The side shifter (20) of claim 5, wherein said lip (87) of said lower intermediate plate (81) contacts the upper surface of said slide block (80) to form a second seal between said slide block (80) and said lower intermediate plate (81).

7. The side shifter (20) of claim 1, wherein said upper and lower horizontal cross members (26,28) are jointed at their ends by vertical support members (30,32), said upper and lower horizontal cross members (26,28) and said vertical support members (30,32) being formed from high strength ferrous extrusions whereby said upper and lower horizontal cross members and said vertical support members can have a smaller cross-sectional size whereby the visibility through said side shifter is improved.

8. The side shifter (20) of claim 7, wherein said upper horizontal cross member (26) defines a slide channel (34), said slide channel (34) being disposed to be slideably positioned on said upper crossbar (44) of said lift truck, said slide channel (34) being a ferrous extrusion that is integrally formed with said upper horizontal cross member (26) whereby the slide channel (34) acts to increase the strength of said upper horizontal cross member.

9. The side shifter (20) of claim 1, wherein at least one retaining plate (56) having a hook (58) positioned on one end is slideably positioned on the lower horizontal cross member (28) said retaining plate being disposed to be adjacent said lower crossbar (46) on said lift truck (10), said hook (58) extending from said retaining plate (56) in a direction towards said lower crossbar (46), said hook being disposed to engage said lower cross bar to secure said frame (24) to said lower crossbar (46).

10. The side shifter (20) of claim 9, wherein said retainer plate (56) is slideably positioned on said lower horizontal cross member (28) by mounting brackets (68) that define a slot (72) for receiving said retainer plate (56), said retainer plate (56) defining an opening (90), a block (118) is movably secured to said lower horizontal cross member (28), said block (118) being disposed to be positioned in said opening (90) in said retainer plate (56) to maintain said retainer plate (56) in a desired vertical position with respect to said lower crossbar (46).

11. The side shifter (20) of claim 10, wherein a passageway (96) extends through said lower horizontal cross member (28), said passageway (96) has a section (98) of reduced diameter positioned adjacent said retainer plate (56), said section (98) forming a shoulder (100) in said passageway, a bolt (108) having a shaft (107) with a threaded portion (110) at one end and a head (112) at the other end being movably positioned in said passageway (96), said block (118) being threadingly secured to said threaded end (110) of said bolt (108), said bolt (108) acting to movably maintain said block (118) in alignment with said opening (90) in said retainer plate (56).

12. The side shifter (20) of claim 11, wherein a biasing means (128) acts on said bolt (108) to bias said block (118) into said opening (90).

13. The side shifter (20) of claim 12, wherein said biasing means (128) is a spring that extends from said shoulder (100) in said passageway (96) to said head (112) on said bolt (108), said spring biasing said bolt (108) to maintain said block (118) in contact ,with said lower horizontal member (28) and in said opening (90) in said retainer plate (56) to maintain the vertical position of said retainer plate (56).

14. The side shifter (20) of claim 13, wherein said block (118) has at least two side edges (124) that are disposed for engaging said opening (90) in said retainer plate (56), said opening having an edge (94) that is disposed for engagement with said side edges, said side edges (124) being positioned at different distances from said bolt (108) whereby the vertical position of said retainer plate (56) will change depending on which side edge (124) of said block (118) is in contact with the edge (94) of said opening (90), said bolt (108) being rotatable to change which side edge (124) of said block (118) engages said opening (90).

15. The side shifter (20) of claim 14, wherein said opening (90) is substantially rectangular in shape, an edge (94) of said opening having a notch (92) positioned therein, said notch (92) being disposed to fit around said shaft (107) of said bolt (108) when said bolt is advanced in said passageway (96) to displace said block (118) from said opening (90) whereby said retainer plate (56) can be displaced further to secure said side shifter (20) to said fork lift truck.

16. The side shifter (20) of claim 15, wherein said block (118) is substantially rectangular in shape.

17. The side shifter (20) of claim 10, wherein said slide block (80) extends between said mounting brackets (68) positioned on opposite ends of said lower horizontal cross member (28) that position said retainer plates (56), said slide block (80) having an upper extension (71) and a lower extension (73) that extend over said lower horizontal cross member (28), said upper and lower extensions (71,73) and said mounting brackets (68) acting to maintain said slide block (80) in position with respect to said lower horizontal cross member (28).

18. A retainer (22) for securing a lift truck attachment (20) to a lift truck carriage (10) carriage:

a retainer plate (56) having a hook (58) on one end slideably positioned on said attachment, said hook (58) being disposed to engage said carriage of said lift truck (10);

an opening (90) positioned in said retainer plate (56);

a block (118) movably secured to said attachment, said block (118) being disposed to be positioned in said opening in said retainer plate (56) to maintain said retainer plate (56) in a desired position with respect to said carriage of said lift truck (10);

a passageway (96) extending through said attachment, said passageway (96) having a section (98) of reduced diameter positioned adjacent said retainer plate (56), said section of reduced diameters (98) forming a shoulder (100) in said passageway;

a bolt (108) having a shaft (107) with a threaded portion (110) at one end and a head (112) at the other end being movably positioned in said passageway (96), said block (118) being threadingly secured to said threaded end (110) of said bolt (108), said bolt acting to movably maintain said block (118) in alignment with said opening (90) in said retainer plate (56); and a biasing means (128) acting on said bolt (108) to bias said block (118) into said opening (90).

19. The retainer of claim 18, wherein said biasing means (128) is a spring that extends from said shoulder (100) in said passageway (96) to said head (112) on said bolt (108), said spring biasing said bolt (108) to maintain said block (118) in said opening (90) in said retainer plate (56) to maintain the desired position of said retainer plate (56).

20. The retainer of claim 19, wherein said block (118) has at least two side edges (124) that are disposed for engaging said opening (90)in said retainer plate (56), said opening having an edge (94) that is disposed for engagement with said side edges, said side edges (124) of said block (118) being position at different distances from said bolt (108) whereby the desired position of said retainer plate (56) will change depending on which side edge (124) of said block (118) is in contact with the edge of said opening (90), said bolt (108) being rotatable to change which side edge (124) of said block (118) engages said opening (90).

21. The retainer of claim 20, wherein said opening (90) is substantially rectangular in shape, said upper edge (94) of said opening having a notch (92) positioned therein, said notch being disposed to fit around said shaft (107) of said bolt (108) when said bolt is advanced in said passageway (96) to displace said block (118) from said opening (90) whereby said retainer plate (56) can be displaced further to secure said attachment (20) to said lift truck.

22. The retainer of claim 21, wherein said block (118) is substantially rectangular in shape.

* * * * *